US005662748A

United States Patent [19]

Mizoguchi et al.

[11] Patent Number: 5,662,748

[45] Date of Patent: Sep. 2, 1997

[54] THIN CAST STRIP AND THIN STEEL SHEET OF COMMON CARBON STEEL CONTAINING LARGE AMOUNTS OF COPPER AND TIN AND PROCESS FOR PRODUCING THE SAME

[75] Inventors: Toshiaki Mizoguchi; Yoshiyuki Ueshima; Takashi Moroboshi; Kiyomi Shio, all of Futtsu, Japan

[73] Assignee: Nippon Steel Corporation, Tokyo, Japan

[21] Appl. No.: 325,321

[22] PCT Filed: Feb. 25, 1994

[86] PCT No.: PCT/JP94/00313

§ 371 Date: Nov. 25, 1994

§ 102(e) Date: Nov. 25, 1994

[87] PCT Pub. No.: WO94/19503

PCT Pub. Date: Sep. 1, 1994

[30] Foreign Application Priority Data

Feb. 26, 1993 [JP] Japan ..... 5-037164

[51] Int. Cl.[6] ..... C22C 38/16; B22D 11/00

[52] U.S. Cl. ..... 148/332; 148/541; 148/546

[58] Field of Search ..... 148/540, 541, 148/546, 332

[56] References Cited

U.S. PATENT DOCUMENTS 3,960,610 6/1976 Breedijk .
4,204,888 5/1980 Hakaru et al. .
5,051,138 9/1991 Iwanaga et al. ..... 148/546

FOREIGN PATENT DOCUMENTS 4162943 6/1992 Japan .
4289136 10/1992 Japan .

OTHER PUBLICATIONS

L.T. Shang and P.J. Wray, "The Microstructure of Strip Cast Low–Carbon Steels & Their Response To Thermal Processing, Metallurgical Translactions A," vol. 20A Jul. 1989 pp. 1191–1198.

*Primary Examiner*—Deborah Yee
*Attorney, Agent, or Firm*—Kenyon & Kenyon

[57] ABSTRACT

The present invention provides a thin cast strip or a thin steel sheet having good cast strip properties and mechanical properties from a molten steel containing a large amount of iron scrap containing Cu and Sn. The thin cast strip or thin steel sheet is characterized by being a thin cast strip or thin steel sheet of a common carbon steel comprising 0.15 to 10% by weight of Cu and 0.03 to 0.5% by weight of Sn, the primary dendrite spacing on a surface layer portion being in the range of from 5 to 100 μm.

8 Claims, 2 Drawing Sheets

THIN CAST STRIP AND THIN STEEL SHEET OF COMMON CARBON STEEL CONTAINING LARGE AMOUNTS OF COPPER AND TIN AND PROCESS FOR PRODUCING THE SAME

TECHNICAL FIELD

The present invention relates to a thin cast strip and a thin steel sheet of a common carbon steel produced by using as a raw material molten steel containing large amounts of copper and tin obtained by melting and refining scrap iron or tin plate scrap generated, for example, by dismantling of automobiles or electric appliances, and a process for producing the same.

BACKGROUND ART

In the prior art, in order to reuse scrap iron, tin plate scrap, etc., these scrap metals had to be fed in suitable amounts into molten steel at the time of refining of the molten steel. The molten steel containing the scrap iron and the like was then refined and subjected to ingot making or continuous casting to prepare an ingot or a slab having a thickness of not less than 100 mm which was then rolled to prepare a thin sheet or the like.

Particularly in recent years, however, the amount of copper contained in scrap iron has become large. When an ingot or a slab Containing the scrap iron or tin plate scrap is hot-rolled and, if necessary, then cold-rolled to prepare a thin steel sheet having a thickness in the range of from 0.1 to 15 mm, red-shortness occurs in the ingot or cast strip in the course of the hot rolling and hot tear frequently occurs, which makes it difficult to conduct hot rolling, so that the production of the above-described thin steel sheet becomes very difficult.

The red-shortness occurs as follows. When a cast strip or the like is heated before hot rolling, since copper (Cu) and tin (Sn) are less likely to scale, they are enriched on the surface layer portion of the cast strip without being removed as a scale. The enriched Cu and Sn form a low-melting liquid film and, at the same time, are unevenly distributed at grain boundaries, which renders the grain boundaries fragile at a hot rolling temperature, so that red shortness occurs.

Further, Cu and Sn are ingredients which are difficult to remove from molten steel by refining.

Therefore, scrap iron and the like containing large amounts of Cu and Sn are blended little by little in many divided charges for use in lowered Cu and Sn concentrations.

The above method, however, presents the problem that the Cu and sn concentrations of the steel product gradually increase during a use cycle for a long period of time. Further, the control and work associated with the blending of the scrap iron little by little in many divided charges are very troublesome.

In order to solve the above problem, as described in "Tekko To Gokin Genso" (volume one), 1967, pp. 381 and 385, the addition of Ni in an amount satisfying the following formula to molten steel has been carried out in the art.

$$Ni\% \geqq 1.6(Cu\%+6Sn\%)$$

It is considered that Ni added to the above-described molten steel co-exists in a Cu-enriched layer in the grain boundary, which is an origin of the above cracking, and serves to increase the melting point of that portion and to increase the solubility of Cu in the matrix, so that it prevents the occurrence of a liquid film.

However, for a molten metal containing large amounts of Cu and Sn, for example, 0.3 to 10% by weight of Cu and 0.03 to 0.5% by weight of Sn, the necessary Ni concentration amounts to 0.8 to 21% by weight, which is a large problem from the viewpoint of cost and also from the viewpoint of properties due to occurrence of uneven surface plating and poor descaling derived from internal oxidation.

The present invention has been made with a view to solving the above problems, and an object of the present invention is to provide a thin cast strip and a thin steel sheet having a desired thickness and no surface cracking from a molten metal comprising common carbon steel ingredients, with scrap iron and tin plate scrap containing a large amount of Cu being added thereto.

Another object of the present invention is to efficiently provide a thin cast strip and a thin steel sheet having a desired thickness and no surface cracking without conducting troublesome control and work wherein scrap iron or tin plate scrap containing a large amount of Cu is blended little by little.

A further object of the present invention is to provide a thin cast strip and a thin steel sheet having a desired thickness and no surface cracking from a molten steel comprising common carbon steel ingredients not containing Ni and, added thereto, scrap iron and tin plate scrap containing a large amount of Cu being added thereto.

A further object of the present invention is to provide common carbon steel thin cast strip and thin steel sheet which contain large amounts of Cu and Sn and have excellent mechanical properties and surface quality.

DISCLOSURE OF INVENTION

In order to attain the above objects, the present inventors have made various studies on cast strips comprising common carbon steel ingredients and, added thereto, scrap iron containing Cu and Sn and, as a result, have found that when the microstructure of the cast strip is brought to a fine dendrite structure having a primary dendrite spacing in the range of from 5 to 100 μm, a cast strip having no significant variation in strength and elongation and a surface cracking depth of not more than 30 μm, i.e., and a very excellent surface appearance, can be prepared without adding Ni.

A cast strip having the above-described dendrite structure can be prepared by rapidly cooling molten steel containing large amounts of Cu and Sn at a cooling rate of 1° to $10^4$° C./sec (heat removal rate (Q) of casting roll: 5,000,000 to 15,000,000 kcal/$m^2$/hr) to prepare a thin cast strip having a sheet thickness in the range of from 0.1 to 15 mm and, if necessary, conveying the cast strip so as not to hold the cast strip at a temperature of 1000° C. or above for 10 sec or longer.

More specifically, iron scrap is charged and dissolved in molten steel to homogeneously disperse the elements as ingredients, such as Cu and Sn, and in this state, the molten steel is rapidly cooled. Since the cast strip is rapidly solidified to form a thin sheet, there is substantially no flow time for the molten metal in the massy zone at the center portion of the cast strip, so that macrosegregation does not occur in the center portion of the cast strip.

Further, since the diffusion rate of Cu and Sn is inversely proportional to the second power of the primary dendrite spacing, the formation of a structure having a small primary dendrite spacing by rapid solidification of molten steel can increase the diffusion rate of Cu and Sn in the primary dendrite spacing, thereby enabling the degree of segregation between dendrites to be remarkably lowered. Thus, a thin cast strip having a fine dendrite structure free from segregation can be provided.

Further, since a thin cast strip corresponding to a hot-rolled material is produced directly from a molten metal, heat treatment such as that conducted for hot rolling is not necessary, so that the segregation of Cu and Sn on the surface layer of a cast strip does not occur, which enables a cast strip having an excellent surface appearance free from surface defects to be produced.

In some cases, the temperature of the cast strip after emergence from the casting device reaches or exceeds 1000° C. due to recuperation, and if it is held at that temperature for 10 sec or longer, surface segregation of Cu or the like may occur. For this reason, in order to more stably provide a thin cast strip, it is preferred to water-cool the cast strip in the course of conveying to lower the cast strip temperature to 1000° C. or below.

The thin cast strip having a thickness of 0.1 to 15 mm thus obtained has a fine dendrite structure having a primary dendrite spacing of 5 to 100 μm, preferably 5 to 70 μm, at least at its surface layer portion. The primary dendrite spacing at the center portion of a thin cast strip having a sheet thickness of 15 mm is about 300 μm. In this case, the formation of a primary dendrite spacing of 5 to 100 μm on the surface portion thereof, that is, at a depth of about 2 mm from the surface of one side thereof, enables the rate of diffusion of Cu and Sn into the matrix during solidification or immediately after the solidification to be sufficiently accelerated, which contributes to a reduction in microsegregation between dendrites. Thus, since the segregation of the surface layer into the grain boundary can be prevented, the object of the present invention can be attained.

In the present invention, the as-cast thin cast strip or the thin cast strip, which has been pickled after casting, is used as a product corresponding to a hot-rolled steel sheet. In addition, the thin cast strip can also be pickled, cold-rolled and then annealed to produce a cold-rolled steel sheet product.

In this case, since the annealing is carried out at a heating temperature of 800 to 900° C., no problem associated with red-shortness occurs. Further, since enrichment of Cu, Sn and the like does not occur, surface cracking caused by conveying or cold rolling does not occur.

BEST MODE FOR CARRYING OUT THE INVENTION

The best mode for carrying out the invention will now be described.

At the outset, the chemical ingredients constituting the present invention will be described.

When the material of the present invention is used as a material for hot-rolled steel sheet, the fundamental chemical ingredients thereof are those of common carbon steel sheets of steel product designation "SPHC" specified in JIS G3131 (corresponding to a hot-rolled soft steel sheet for a general structure: ASTM A621-82), steel product designation "SS41" specified in JIS G3101 (corresponding to a hot-rolled soft steel sheet for a general structure: ASTM A569-72), steel product designation "SPH3" specified in JIS G3132 (corresponding to a hot-rolled carbon steel strip for a steel pipe: SAE 1026) and steel product designation "S48C" specified in JIS G4051 (corresponding to a carbon material for machine structural use; ASTM A446-85).

On the other hand, when the thin cast strip of the present invention is cold-rolled, the fundamental chemical ingredients of the cold-rolled steel sheet are those of a common carbon steel sheet of steel product designation "SPCC" specified in JIS (corresponding to a cold-rolled steel sheet for a general structure: ASTM A619-82).

Representative percentage compositions of a material corresponding to a hot-rolled steel sheet and a cold-rolled steel sheet are as follows.

| (Material corresponding to hot-rolled steel sheet) | | | |
|---|---|---|---|
| C | Si | Mn | P |
| 0.03–0.5 | 0.01–0.3 | 0.1–2 | 0.001–0.05 |
| S | | Fe | |
| 0.001–0.05 | | Balance | |
| (Cold-rolled steel sheet) | | | |
| C | Si | Mn | P |
| 0.03–0.05 | 0.005–0.015 | 0.1–0.2 | 0.005–0.02 |
| S | | Fe | |
| 0.002–0.01 | | Balance | |

0.3 to 10% of Cu and 0.03 to 0.5% of Sn are added to the above fundamental chemical ingredients. Steels having Cu and Sn contents below the above lower limits can be produced by a conventional process, that is, continuous casting or ingot-making—hot rolling—cold rolling—pickling—annealing, without the use of the process of the present invention.

In most cases, the contents of Cu and Sn contained in scrap iron do not exceed the above upper limits. For this reason, in the present invention, the amounts of Cu and Sn added are limited to the above respective ranges.

The process for producing a steel according to the present invention will now be described.

Figure 2:
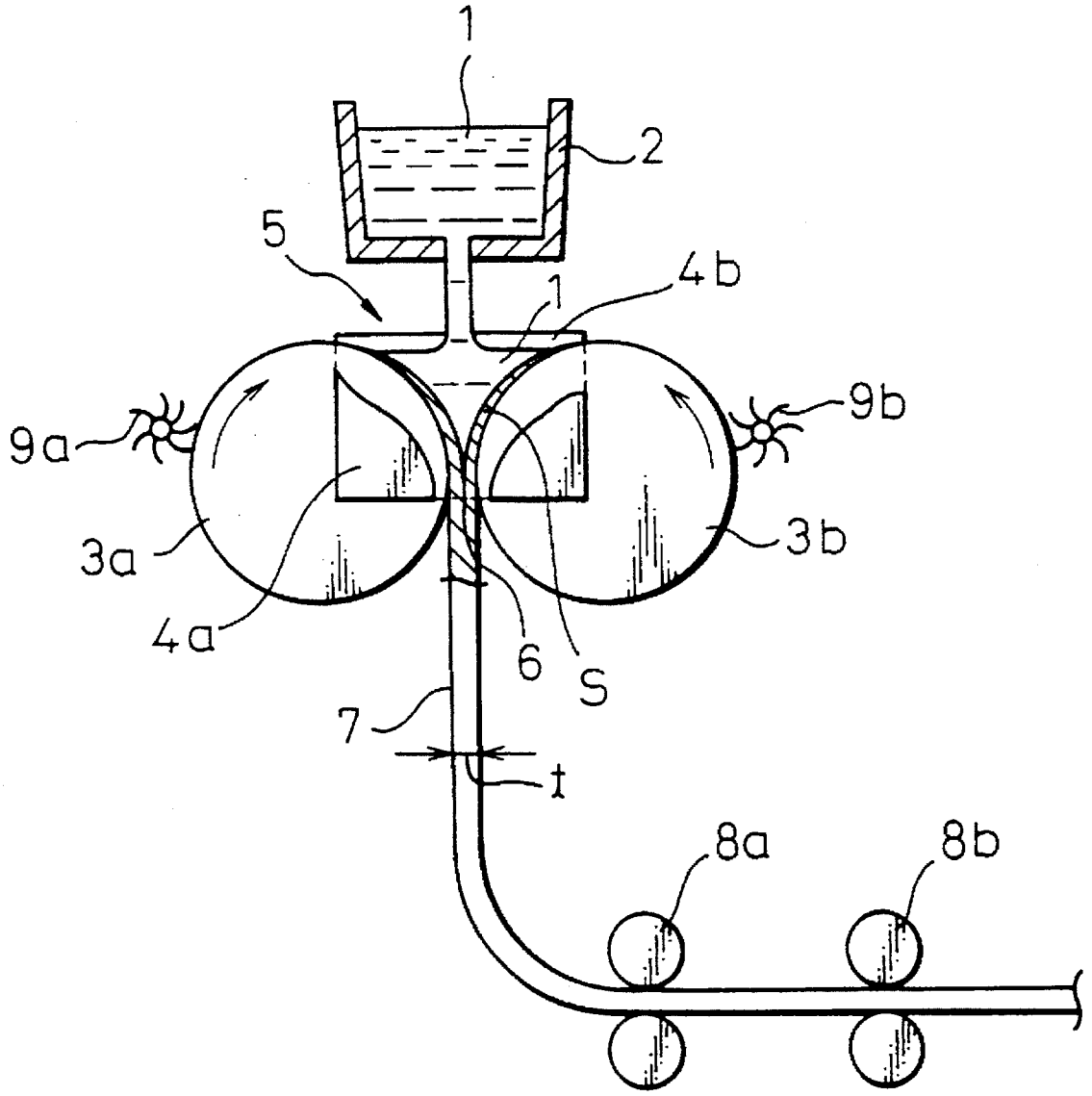
FIG. 2 is a schematic partially sectional front view of a twin roll continuous casting machine.

Molten steel with scrap iron, tin plate or the like being charged and dissolved therein in an early stage of refining of steel is refined and cast into a thin cast strip, for example, by a twin roll continuous machine shown in FIG. 2.

In the drawing, numeral 2 designates a tundish which serves as a reservoir for the molten steel 1 and, at the same time, to pour the molten steel through a nozzle (not shown) provided at a lower part of the tundish into a molten steel pouring basin 5 comprising cooling rolls 3*a*, 3*b* and side weirs 4*a*, 4*b*. The cooling rolls 3*a*, 3*b* are each a roll having an internal cooling portion in the inside thereof and comprising a material having a high heat transfer coefficient, for example, copper, and provided horizontally and parallelly and further rotatably in the direction of an arrow while leaving a space there between corresponding to a desired cast strip.

The molten steel 1 poured into the pouring basin 5 is cooled with the cooling rolls 3*a*, 3*b* to form a solidified shell S on the cooling rolls 3*a*, 3*b*. The thickness of the solidified shells S is increased with the rotation of the cooling rolls, and the solidified shells S are integrated with each other at a kissing point 6 to form a cast strip 7. The cast strip 7 is drawn downward and conveyed to a coiler (not shown) by means of conveying rolls 8*a*, 8*b*. Numerals 9*a*, 9*b* represent cleaners for cleaning the surface of the cooling rolls.

The most important feature of the present invention resides in the primary dendrite spacing of the casting structure. Therefore, the cooling solidification rate of the molten steel which governs this spacing, that is, the average rate of cooling (heat removal rate Q of casting roll) from the liquidus line temperature to the solidus line temperature. This cooling rate is the rate of cooling of the molten metal from the time it is located in the vicinity of the surface of the pouring basin 5, where the molten steel first comes into contact with the cooling rolls, until the molten metal reaches the kissing point 6. In the present invention, the cooling rate defined above is in the range of from 1° to $10^{4}$° C./sec (heat removal rate Q of casting roll: 5,000,000 to 15,000,000 kcal/$m^2$/hr) when the sheet thickness of the cast strip is in the range of from 0.1 to 15 mm.

That is, the average cooling rate of the center portion of a cast strip having a sheet thickness of 15 mm is specified to about 1° C./sec, and the average cooling rate of the surface of the cast strip is specified to about $10^2$ to $10^{4}$° C./sec. The primary dendrite spacing is a function of the cooling rate and, at the same time, related to the chemical composition of the molten steel, particularly its C content. In the chemical composition range of a common carbon steel contemplated in the present invention, the primary dendrite spacing is in the range of from 5 to 300 μm when the sheet thickness of the cast strip and the cooling rate are in the above respective ranges. However, in order to conduct diffusion without enrichment of Cu and Sn on the surface layer at its grain boundary, at least the primary dendrite spacing in a depth of 2 mm from the surface layer (surface layer portion) may be 5 to 100 μm to reduce the microsegregation between the dendrites during solidification. Also when the sheet thickness of the cast strip is 15 mm, the above cooling rate brings the primary dendrite spacing on the surface layer portion to 5 to 100 μm, so that the object of the present invention can be sufficiently attained.

When the sheet thickness exceeds 15 mm, the above primary dendrite spacing cannot be stably provided.

The sheet thickness of 0.1 mm is the lower limit of the sheet thickness of a cast strip which can be produced on a commercial scale, and a cast strip having such a thickness can be, of course, cooled at a high cooling rate and, therefore, can have a primary dendrite spacing of about 5 μm.

The surface layer portion of the thin cast strip having a thickness in the range of from 0.1 to 15 mm thus obtained has a fine dendrite structure having a primary dendrite spacing in the range of from 5 to 100 μm, and the center portion of the cast strip is also free from macrosegregation and has a very homogeneous quality.

Therefore, the as-cast product corresponding to a hot-rolled material or the cold-rolled steel sheet according to the present invention has excellent mechanical properties and, at the same time, a good surface appearance despite the fact that it contains large amounts of Cu and Sn.

As described above, Ni serves to raise the melting point of the Cu-enriched layer at the grain boundary or to increase the solubility of Cu in the matrix. Also in the present invention, Ni may be added in an amount in the range of from 0.02 to 0.7%.

EXAMPLES

Example 1

Molten steels (labeled A to E) having compositions specified in Table 1 (comprising ingredients constituting a hot-rolled mild steel sheet for a general structure (corresponding to JIS-G3131: ASTM A621-82) and, added thereto, Cu and Sn) were cast into thin cast strips having a sheet thickness of 3 mm and a sheet width of 350 mm and were produced at a heat removal rate (Q) of a casting roll of 7,700,000 kcal/$m^2$/hr by using a twin roll continuous casting machine (comprising an internal water cooled copper alloy casting roll (diameter: 400 mm, width: 350 mm) shown in FIG. 2. The average primary dendrite spacing of each thin cast strip (sample Nos. 1 to 5) was 3 to 50 μm. The quality (cracking) and the mechanical properties (strength, elongation, bending and corrosion resistance) for each thin cast strip are given in Table 2.

TABLE 1

| Steel | C | Si | Mn | P | S | Cu | (wt. %) Sn |
|---|---|---|---|---|---|---|---|
| A | 0.04 | <0.02 | 0.17 | 0.012 | 0.005 | 0.1 | 0.02 |
| B | 0.04 | <0.02 | 0.17 | 0.012 | 0.005 | 1.1 | 0.04 |
| C | 0.04 | <0.02 | 0.17 | 0.012 | 0.005 | 4.0 | 0.04 |
| D | 0.04 | <0.02 | 0.17 | 0.012 | 0.005 | 6.2 | 0.04 |
| E | 0.04 | <0.02 | 0.17 | 0.012 | 0.005 | 8.1 | 0.04 |

TABLE 2

| Sample No. | Steel | Strength (kgf/$mm^2$) | Elongation (%) | Bending | Corrosion Resistance | Cracking of Cast Strip: Process of Invention | Cracking of Cast Strip: Conventional Process |
|---|---|---|---|---|---|---|---|
| 1 | A | 30 | 37 | Successfully bent to close contact | c | None | None |
| 2 | B | 30 | 37 | Successfully bent to close contact | b | None | Occurred |
| 3 | C | 30 | 36 | Successfully bent to close contact | a | None | Occurred |
| 4 | D | 30 | 36 | Successfully bent to close contact | a | None | Occurred |
| 5 | E | 30 | 36 | Successfully bent to close contact | a | None | Occurred |

In the table, "Conventional Process" means a process wherein molten steels labeled A to E are cast by the conventional continuous casting process into slabs having a thickness of 250 mm and a width of 1800 mm, which were then hot-rolled into hot-rolled sheets having a sheet thickness of 3 mm. "Bending" represents the results of a 180° close-contact bending test, and "Corrosion resistance" is expressed in corrosion resistance scores (corrosion rate (mm/Y): c: >0.05, b: 0.01 to 0.05, a: <0.01). "Cracking of Cast Strip: None" means cracking having a depth of not more than 30 μmm on the surface layer of the cast strip.

As is apparent from the above tables, the thin cast strips (sample Nos. 2 to 5) of the present invention were excellent in both cast strip quality and mechanical properties, whereas the comparative thin cast strip (sample No. 1) had poor corrosion resistance due to a low Cu content. Further, for all the hot-rolled sheets produced by the conventional process except for sample No. 1, a surface crack having a thickness of not less than 30 μm was observed. For sample No. 1, the Cu and Sn contents were so low that even the hot-rolled sheet produced by the conventional process gave rise to neither red shortness nor surface cracking.

Figure 1:
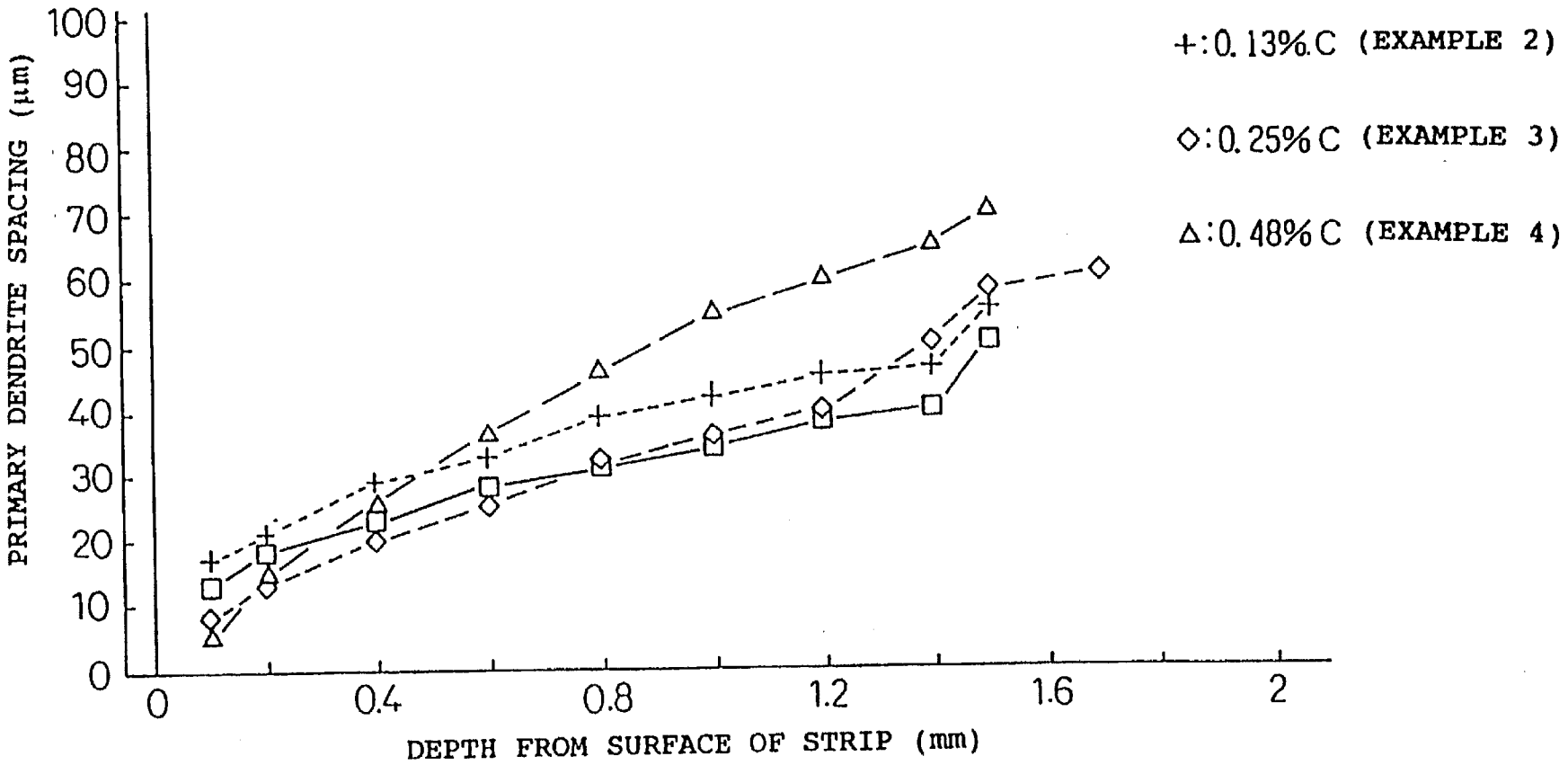
FIG. 1 is a diagram showing the relationship between the depth (mm) from the surface of a cast strip and the primary dendrite spacing (μm)

The relationship between the depth (mm) from the surface of a cast strip in each example and the primary dendrite spacing (μm) is shown in FIG. 1. In the figure, data for the present examples are indicated by the mark □. When the depth from the surface of the cast strip was 0.1 mm, the primary dendrite spacing was 13 μm, while when the depth from the cast strip was 1.5 mm (center portion), the primary dendrite spacing was 50 μm.

The thin cast strips (products corresponding to hot-rolled materials) produced by the above passes of the present invention were pickled, and 6 passes of cold rolling (tandem) were carried out to prepare 0.8 mm-thick cold-rolled sheets. Thereafter, the cold-rolled sheets were subjected to box annealing in such a manner that they were heated to 650° C. at a temperature increase rate of 50° C./hr, held at that temperature for 12 hr and then cooled to room temperature over a period of 48 hr.

Subsequently, the as-annealed steel sheets were subjected to temper rolling with a reduction ratio of 1% to prepare cold-rolled steel sheets for a general structure (JIS-steel product designation SPCC (ASTM A619-82)) containing Cu and Sn.

The primary dendrite spacing for each steel sheet (sample Nos. 6 to 10) was the same as that for the above thin cast strips, and the surface cracking and mechanical properties are given in Table 3.

TABLE 3

| Sample No. | Steel | Strength (kgf/mm$^2$) | Elongation (%) | Hardness (Hv) | Bending | Corrosion Resistance | Surface Cracking: Process of Invention | Surface Cracking: Conventional Process |
|---|---|---|---|---|---|---|---|---|
| 6 | A | 30 | 39 | 110 | Successfully bent to close contact | c | None | None |
| 7 | B | 31 | 38 | 111 | Successfully bent to close contact | b | None | Occurred |
| 8 | C | 30 | 37 | 109 | Successfully bent to close contact | a | None | Occurred |
| 9 | D | 31 | 37 | 111 | Successfully bent to close contact | a | None | Occurred |
| 10 | E | 30 | 37 | 110 | Successfully bent to close contact | a | None | Occurred |

As is apparent from the above table, all steel sheets of samples Nos. 7 to 10 had excellent mechanical properties and a surface crack of not more than 30 μm in depth, that is, were very excellent as SPCC materials containing Cu and Sn.

Example 2

Molten steels comprising ingredients specified in Table 4, that is, ingredients constituting a hot-rolled steel sheet for a general structure (corresponding to steel product designation SS41 specified in JIS G3101: corresponding to ASTM A569-72) and, added thereto, Cu and Sn were cast into thin cast strips having a sheet thickness of 3 mm and a sheet width of 350 mm in the same manner as in Example 1, except that the heat removal rate (Q) of the casting roll was 8,000,000 kcal/m$^2$/hr. The primary dendrite spacing of each thin cast strip (sample Nos. 11 to 15) was 17 to 55 μm on the average, as indicated by the mark "t" in FIG. 2. The quality (cracking) and the mechanical properties of each thin cast strip are given in Table 5.

TABLE 4

| Steel | C | Si | Mn | P | S | Cu | Sn (wt. %) |
|---|---|---|---|---|---|---|---|
| F | 0.13 | 0.25 | 0.8 | 0.012 | 0.005 | 0.1 | 0.02 |
| G | 0.13 | 0.25 | 0.8 | 0.012 | 0.005 | 1.1 | 0.04 |
| H | 0.13 | 0.25 | 0.8 | 0.012 | 0.005 | 4.0 | 0.16 |
| I | 0.13 | 0.25 | 0.8 | 0.012 | 0.005 | 6.1 | 0.20 |
| J | 0.13 | 0.25 | 0.8 | 0.012 | 0.005 | 8.0 | 0.40 |

TABLE 5

| Sample No. | Steel | Tensile Strength (kgf/mm²) | Elongation (%) | Bending | Corrosion Resistance | Cracking of Cast Strip: Process of Invention | Cracking of Cast Strip: Conventional Process |
|---|---|---|---|---|---|---|---|
| 11 | F | 47 | 26 | Acceptable | c | None | None |
| 12 | G | 47 | 26 | Acceptable | b | None | Occurred |
| 13 | H | 48 | 25 | Acceptable | a | None | Occurred |
| 14 | I | 48 | 25 | Acceptable | a | None | Occurred |
| 15 | J | 48 | 25 | Acceptable | a | None | Occurred |

In Table 5, the indications were identical to those in Table 2 showing the results of Example 1 except for the column of "Bending." In the column of "Bending," the bending was evaluated as "Acceptable" in the case of radius/sheet thickness <1.5.

As is apparent from the above table, the thin cast strips (sample Nos. 12 to 15) were excellent in both the cast strip quality and mechanical properties despite the fact that they contained large amounts of Cu and Sn.

Thereafter, molten steels comprising C and Si in the same respective contents as the molten steels specified in Table 4 and, added thereto, minor amounts of Ti, Nb, B, Cr, Mo, V, etc. (molten steels comprising ingredients constituting a high-tensile, low-alloy, hot-rolled thin sheet having an improved workability (corresponding to steel product designation SPFC45 specified in JIS G3135: ASTM A715-85) and, added thereto, Cu and Sn), that is, molten steels specified in Table 6, were cast into thin cast strips having a sheet thickness of 3 mm and a sheet width of 350 mm in the same manner as described above in connection with the steels having compositions specified in Table 4. The primary dendrite spacing for each thin cast strip (sample Nos. 16 to 19) was identical to that for sample Nos. 11 to 15, and the cast strip quality and mechanical properties were also excellent as given in Table 7.

TABLE 6

| Steel | C | Si | Mn | P | S | Ti | Nb | B | Cr | Mo | V | Zr | Cu | Sn |
|---|---|---|---|---|---|---|---|---|---|---|---|---|---|---|
| | | | | | | (wt. % except for B in wt. ppm) | | | | | | | | |
| K | 0.13 | 0.25 | 1.3 | 0.012 | 0.01 | 0.08 | — | — | — | — | — | — | 3.0 | 0.05 |
| L | 0.13 | 0.25 | 1.3 | 0.012 | 0.01 | — | — | — | — | — | 0.03 | — | 3.1 | 0.07 |
| M | 0.13 | 0.25 | 1.3 | 0.012 | 0.01 | 0.08 | 0.04 | 2 | 0.04 | — | — | 0.06 | 3.1 | 0.07 |
| N | 0.13 | 0.25 | 1.3 | 0.012 | 0.01 | — | 0.04 | — | — | 0.25 | — | — | 3.0 | 0.07 |

TABLE 7

| Sample No. | Steel | Tensile Strength (kgf/mm²) | Elongation (%) | Bending | Corrosion Resistance | Cracking of Cast Strip: Process of Invention | Cracking of Cast Strip: Conventional Process |
|---|---|---|---|---|---|---|---|
| 16 | K | 45 | 26 | Acceptable (1) | a | None | Occurred |
| 17 | L | 45 | 26 | Acceptable (1) | a | None | Occurred |

TABLE 7-continued

| Sample No. | Steel | Tensile Strength (kgf/mm²) | Elongation (%) | Bending | Corrosion Resistance | Cracking of Cast Strip: Process of Invention | Cracking of Cast Strip: Conventional Process |
|---|---|---|---|---|---|---|---|
| 18 | M | 55 | 25 | Acceptable (2) | a | None | Occurred |
| 19 | N | 58 | 25 | Acceptable (2) | a | None | Occurred |

In the column of "Bending" in Table 7, the bending property was evaluated as "Acceptable (1)" when the bending diameter/sheet thickness value was less than 1, while the bending property was evaluated as "Acceptable (2)" when the bending diameter/sheet thickness value was less than 1.5. The other indications in Table 7 were identical to those in Table 2 showing the results of Example 1.

Example 3

Molten steels (steels D to S) having compositions specified in Table 8 (comprising chemical ingredients constituting a hot-rolled carbon steel strip for a steel pipe (corresponding to steel product No. SPHT3 specified in JIS G3132: SAE1026) and, added thereto, Cu and Sn) were cast into thin cast strips having a sheet thickness of 3.5 mm and a sheet width of 350 mm in the same manner as in Example 1, except that the heat removal rate (Q) of the cast roll was 6,700,000 kcal/m²/hr. The primary dendrite spacing of each thin cast strip (sample Nos. 20 to 24) was 8 to 60 μm on the average, as indicated by the mark "◇" in FIG. 2.

The quality (cracking) and the mechanical properties of each thin cast strip are given in Table 9.

TABLE 8

| Steel No. | C | Si | Mn | P | S | Cu | (wt. %) Sn |
|---|---|---|---|---|---|---|---|
| O | 0.25 | 0.3 | 0.8 | 0.02 | 0.01 | 0.1 | 0.02 |
| P | 0.25 | 0.3 | 0.8 | 0.02 | 0.01 | 1.0 | 0.03 |
| Q | 0.25 | 0.3 | 0.8 | 0.02 | 0.01 | 4.1 | 0.15 |
| R | 0.25 | 0.3 | 0.8 | 0.02 | 0.01 | 5.9 | 0.20 |
| S | 0.25 | 0.3 | 0.8 | 0.02 | 0.01 | 8.1 | 0.40 |

TABLE 9

| Sample No. | Steel | Tensile Strength (kgf/mm$^2$) | Elongation (%) | Bending | Corrosion Resistance | Cracking of Cast Strip: Process of Invention | Cracking of Cast Strip: Conventional Process |
|---|---|---|---|---|---|---|---|
| 20 | O | 45 | 28 | Acceptable | c | None | None |
| 21 | P | 45 | 28 | Acceptable | b | None | Occurred |
| 22 | Q | 45 | 27 | Acceptable | a | None | Occurred |
| 23 | R | 45 | 27 | Acceptable | a | None | Occurred |
| 24 | S | 45 | 27 | Acceptable | a | None | Occurred |

In the column of "Bending" in Table 9, the bending property was evaluated as "Acceptable" when the bending radius/sheet thickness value was less than 2.0. The other indications in Table 9 are identical to those in Table 2 showing the results of Example 1.

As is apparent from the above table, the thin cast strips (sample Nos. 21 to 24) of the present invention were excellent in both the cast strip quality and mechanical properties despite the fact that they contained large amounts of Cu and Sn.

Example 4

Molten steels (steels T to X) having compositions specified in Table 10 (comprising chemical ingredients constituting a carbon steel material for machine structural use (corresponding to steel product No. S48C specified in JIS G4051: ASTM A446-85) and, added thereto, Cu and Sn) were cast into thin cast strips having a sheet thickness of 3 mm and a sheet width of 350 mm in the same manner as in Example 1, except that the heat removal rate (Q) of the casting rolls was 8,200,000 kcal$^4$/m$^2$/hr. The primary dendrite spacing of each thin cast strip (sample Nos. 25 to 29) was 5 to 70 μm on the average, as indicated by the mark "Δ" in FIG. 2.

The cast strip quality (cast strip cracking) and the mechanical properties for each thin cast strip are given in Table 11.

TABLE 10

| Steel | C | Si | Mn | P | S | Cu | (wt. %) Sn |
|---|---|---|---|---|---|---|---|
| T | 0.48 | 0.2 | 0.8 | 0.02 | 0.01 | 0.1 | 0.02 |
| U | 0.48 | 0.2 | 0.8 | 0.02 | 0.01 | 1.0 | 0.03 |
| V | 0.48 | 0.2 | 0.8 | 0.02 | 0.01 | 4.1 | 0.15 |

TABLE 10-continued

| Steel | C | Si | Mn | P | S | Cu | (wt. %) Sn |
|---|---|---|---|---|---|---|---|
| W | 0.48 | 0.2 | 0.8 | 0.02 | 0.01 | 6.0 | 0.21 |
| X | 0.48 | 0.2 | 0.8 | 0.02 | 0.01 | 8.0 | 0.39 |

TABLE 11

| Sample No. | Steel | Tensile Strength (kgf/mm$^2$) | Elongation (%) | Bending | Corrosion resistance | Cracking of Cast Strip: Process of Invention | Cracking of Cast Strip: Conventional Process |
|---|---|---|---|---|---|---|---|
| 25 | T | 55 | 20 | Acceptable | c | None | None |
| 26 | U | 55 | 20 | Acceptable | b | None | Occurred |
| 27 | V | 55 | 19 | Acceptable | a | None | Occurred |
| 28 | W | 55 | 19 | Acceptable | a | None | Occurred |
| 29 | X | 55 | 20 | Acceptable | a | None | Occurred |

In the column of "Bending" in Table 11, the bending property was evaluated as "Acceptable" when the bending radius/sheet thickness value was less than 2.0. The other indications in Table 11 are identical to those in Table 2 showing the results of Example 1.

As is apparent from the above table, the thin cast strips (sample Nos. 26 to 29) were excellent in both the cast strip quality and mechanical properties despite the fact that they contained large amounts of Cu and Sn.

INDUSTRIAL APPLICABILITY

According to the present invention, common carbon thin cast strips and thin steel sheets having a good surface appearance and excellent mechanical properties can be produced using iron scrap and tin plate scrap containing a large amount of Cu without adding Ni. Therefore, since the above cast strip and steel sheet can be used at a low cost in corrosion-resisting steel sheet, for example, steel sheets for automobiles, the present invention is very valuable from an industrial viewpoint.

We claim:

1. A thin cast strip of a common carbon steel, consisting essentially of 0.15 to 10% by weight of Cu and 0.03 to 0.5% by weight of Sn, the balance consisting of ingredients constituting a common carbon steel, the primary dendrite spacing of the cast strip on its surface layer portion being in the range of from 5 to 100 μm, said surface layer portion being a layer having a depth of 2 mm from the surface of the cast strip.

2. A common carbon steel sheet comprising a cold-rolled steel sheet produced by cold-rolling a thin cast strip having a thickness in the range from 0.1 to 15 mm, said thin cast strip consisting essentially of 0.15 to 10% by weight of Cu and 0.03 to 0.5% by weight of Sn, the balance consisting of ingredients constituting a common carbon steel, and having a primary dendrite spacing of 5 to 100 μm on a surface layer portion in a depth of 2 mm from the surface of the cast strip.

3. A process for producing a thin cast strip of a common carbon steel, comprising the step of: rapidly solidifying a molten steel consisting essentially of 0.15 to 10% by weight of Cu and 0.03 to 0.5% by weight of Sn with the balance consisting of ingredients constituting a common carbon steel at an average cooling rate of from about $10^{2°}$ to $10^{4°}$ C./sec on the surface of the cast strip, thereby producing the thin cast strip having a primary dendrite spacing of the cast strip in its surface layer portion in a range of from 5 to 100 μm, said surface layer portion being a layer having a depth of 2 mm from the surface of the cast strip.

4. The process according to claim 3, wherein the thickness of the thin cast strip is in the range of from 0.1 to 15 mm.

5. The process according to claim 3, wherein the thin cast strip in the course of conveying after casting is cooled in such a manner that the holding time of said thin cast strip at a surface temperature of 1000° C. or above is not longer than 10 sec.

6. The process according to claim 3, wherein said thin cast strip is cast by a casting device having a movable mold.

7. The process according to claim 6, wherein said casting device is a twin drum casting device.

8. A process for producing a common carbon steel sheet from a thin cast strip, comprising the steps of: rapidly solidifying a molten steel consisting essentially of 0.15 to 10% by weight of Cu and 0.03 to 0.5% by weight of Sn with the balance consisting of ingredients constituting a common carbon steel at an average cooling rate of from about $10^{2°}$ to $10^{4°}$ C./sec on the surface of the cast strip to cast the thin cast strip having a thickness in the range of from 0.1 to 15 mm; thereby producing the thin cast strip having a primary dendrite spacing of the cast strip in its surface layer portion in a range of from 5 to 100 μm, said surface layer portion being a layer having a depth of 2 mm from the surface of the cast strip; and cold-rolling said thin cast strip to prepare a cold-rolled steel sheet.

* * * * *

US005662748B1

REEXAMINATION CERTIFICATE (3922nd)

United States Patent [19]

[11] B1 5,662,748

Mizoguchi et al.

[45] Certificate Issued Nov. 2, 1999

[54] THIN CAST STRIP AND THIN STEEL SHEET OF COMMON CARBON STEEL CONTAINING LARGE AMOUNTS OF COPPER AND TIN AND PROCESS FOR PRODUCING THE SAME

[75] Inventors: Toshiaki Mizoguchi; Yoshiyuki Ueshima; Takashi Moroboshi; Kiyomi Shio, all of Futtsu, Japan

[73] Assignee: Nippon Steel Corporation, Tokyo, Japan

Reexamination Request:
No. 90/005,206, Dec. 31, 1998

Reexamination Certificate for:

| | |
|---|---|
| Patent No.: | **5,662,748** |
| Issued: | **Sep. 2, 1997** |
| Appl. No.: | **08/325,321** |
| Filed: | **Nov. 25, 1994** |

[22] PCT Filed: Feb. 25, 1994

[86] PCT No.: PCT/JP94/00313

§ 371 Date: Nov. 25, 1994

§ 102(e) Date: Nov. 25, 1994

[87] PCT Pub. No.: WO94/19503

PCT Pub. Date: Sep. 1, 1994

[30] Foreign Application Priority Data

Feb. 26, 1993 [JP] Japan ..... 5-037164

[51] Int. Cl.[6] ..... C22C 38/16; B22D 11/00

[52] U.S. Cl. ..... 148/332; 148/541; 148/546

[58] Field of Search ..... 148/332, 541, 148/546, 550

[56] References Cited

U.S. PATENT DOCUMENTS

| | | | |
|---|---|---|---|
| 3,960,615 | 6/1976 | Breedijk . | |
| 4,851,052 | 7/1989 | Nishioka et al. | 148/2 |

FOREIGN PATENT DOCUMENTS

| | | |
|---|---|---|
| 55-16752 | 2/1980 | Japan . |
| 61-206506 | 9/1986 | Japan . |
| 64-21010 | 1/1989 | Japan . |
| 2-236224 | 9/1990 | Japan . |
| 4-162943 | 6/1992 | Japan . |
| 4289136 | 10/1992 | Japan . |

OTHER PUBLICATIONS

Shiang, L.T., and Wray, P.J., "The Microstructure of Strip–Cast Low Carbon Steels and Their Response to Thermal Processing", *Mettalurgical Transactions A*, Jul. 1989, pp. 1191–1198, vol. 20A.

Couture, Alain et al., "Strip Casting Simulation of Low Carbon Aluminum–Killed Steel", *Canadian Metallurgical Quaterly*, 1992, pp. 63–71, vol. 31, No. 1.

Kogiku, Fumio et al., "Rapid Solidification Process of High Silicon Steel Strips and Their Characteristics", *Transactions 1S1J*, 1986 pp. B–141–B–142, vol. 26.

Apelian, D., et al. "Direct Casting of Thin Steel Sections—A Tutorial Review", *Modeling of Casting and Welding Processes IV*, 1988, pp. 229–243.

Nishioka, S.I. et al., "Research on Twin–Roll Casting Processes", *Transactions 1S1J*, 1986, pp. B–147–B–148, vol. 26.

(List continued on next page.)

*Primary Examiner*—Deborah Yee

[57] ABSTRACT

The present invention provides a thin cast strip or a thin steel sheet having good cast strip properties and mechanical properties from a molten steel containing a large amount of iron scrap containing Cu and Sn. The thin cast strip or thin steel sheet is characterized by being a thin cast strip or thin steel sheet of a common carbon steel comprising 0.15 to 10% by weight of Cu and 0.03 to 0.5% by weight of Sn, the primary dendrite spacing on a surface layer portion being in the range of from 5 to 100 μm.

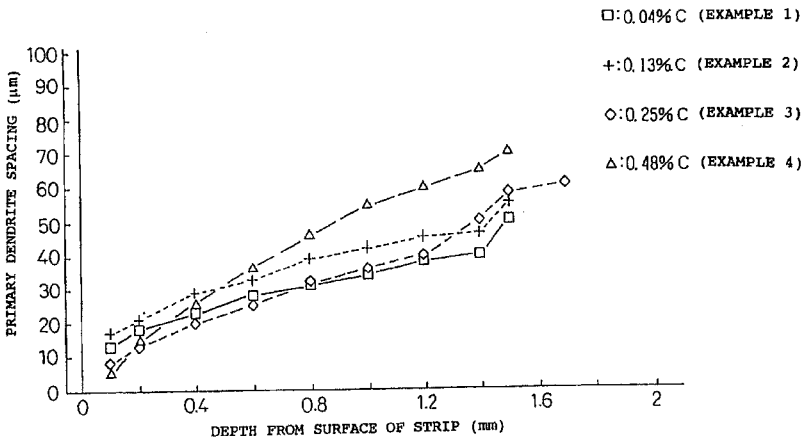

OTHER PUBLICATIONS

Kawakami, Kiminari, et al. "Research on Twin Roll Casting Processes", *Proceedings of the 69th Steelmaking Conference*, Apr. 1986, pp. 861–870, vol. 69.

Krishnadev, M.R., et al., "Influence of Alloying and Processing on Properties of Direct–Cast Steels", *Melt Spinning and Strip Casting* 1992, pp. 123–146.

Proc. $2^{nd}$ European Electric Steel Cong., "On Tramp Element Control In Electric Steelmaking", 1986, pp. 4.8/1–4.8/34, M. Wolf et al.

Canadian Institute of Mining and Metallurgy, "Direct–Cast Steel Strip:Processing and Properties", 1990, J.F. Bingert et al.

Scripta Mettalurgica et Materialia, vol. 25, pp. 143–148, 1991, "Microstructural Study Of Continuously–Annealed Strip–Cast Low Carbon Steel", L.T. Shiang et al.

L.T. Shong and P.J. Wray, The Microstructure of Strip Cost Low–Carbon Steels & Their Response To Thermal Processing, Metallurgical Translactions A, vol. 20A Jul. 1989 pp. 1191–1198.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 to 8 is confirmed.

* * * * *